US006266040B1

(12) United States Patent
Nagatomo

(10) Patent No.: US 6,266,040 B1
(45) Date of Patent: Jul. 24, 2001

(54) INTEGRATED CIRCUIT FOR LIQUID CRYSTAL DISPLAY APPARATUS DRIVE

(75) Inventor: Kenjirou Nagatomo, Miyazaki (JP)

(73) Assignee: Oki Electric Industry Co., Ltd.

( * ) Notice: Subject to any disclaimer, the term of this patent is extended or adjusted under 35 U.S.C. 154(b) by 0 days.

(21) Appl. No.: 09/203,557

(22) Filed: Dec. 2, 1998

(30) Foreign Application Priority Data

Dec. 24, 1997 (JP) ..... 9-366539

(51) Int. Cl.[7] ..... G09G 3/36
(52) U.S. Cl. ..... 345/98; 345/211
(58) Field of Search ..... 345/86, 87, 88, 345/98, 99, 100, 211, 212, 213, 204, 205, 206, 95

(56) References Cited

U.S. PATENT DOCUMENTS 5,317,332 * 5/1994 Kanno et al. ..... 345/101
5,648,791 * 7/1997 Date et al. ..... 345/89
5,774,106 * 6/1998 Nitta et al. ..... 345/98
5,798,741 * 8/1998 Kajihara ..... 345/94

* cited by examiner

*Primary Examiner*—Xiao Wu
(74) *Attorney, Agent, or Firm*—Rabin & Champagne, P.C.

(57) ABSTRACT

A drive circuit for liquid crystal display apparatus is constituted with an input unit that performs input of a digital signal for liquid crystal apparatus drive, a digital/analog conversion unit that converts the digital signal that has undergone a specific type of processing after the input to an analog signal and an amplifier unit that amplifies an output from the digital/analog conversion unit to a signal level required for driving the liquid crystal apparatus. By providing a drive circuit B having an amplification factor alpha >1 at the amplifier unit, the voltage of the signal transmitted from the D/A unit to the amplifier unit is set lower by an amplification factor 1/alpha. Through this structure, a reduction in the pattern area occupied by the D/A unit is achieved so that the number of dots that may be placed within the same pattern area can be increased. As a result, a larger scale for the integrated circuit for liquid crystal display apparatus drive can be achieved.

9 Claims, 11 Drawing Sheets

INTEGRATED CIRCUIT FOR LIQUID CRYSTAL DISPLAY APPARATUS DRIVE

BACKGROUND OF THE INVENTION

The present invention relates to an integrated circuit for liquid crystal display apparatus drive which is employed in a liquid crystal display apparatus (hereafter referred to as a TFT panel) driven at a high potential.

TFT panels have been employed in an increasingly wide range of applications in recent years. This has resulted regarding an intensified effort in technological developments for liquid crystal display system in all technical areas in which image display is required. The need for achieving larger scale and higher resolution display are particularly urgent.

In order to achieve larger scale, it is crucial to increase the scale of the integrated circuit for liquid crystal display apparatus drive and a reduction in the power consumption, since one drive circuit ls required per liquid crystal dot and the number of drive circuits, therefore, increases in proportion to increases in scale and in resolution.

In other technological areas, source voltages for integrated circuits have been steadily reduced in order to reduce power consumption, and at present, the source voltages for most integrated circuits are already down to 2.7V.

However, a drive voltage of approximately 10V is still required for integrated circuits for liquid crystal display apparatus drives, some of which require a large electric field intensity due to the unique quality of liquid crystal drive.

Thus, since a drive voltage of approximately 10V is required to fully realize liquid crystal drive performance, a low voltage portion where signal processing is performed and a high voltage portion where liquid crystal drive is performed coexist in an integrated circuit for liquid crystal display apparatus drive.

However, in an integrated circuit, the pattern area of the high voltage portion is larger relative to the pattern area of the low voltage portion, even when the pattern is otherwise identical.

Consequently, the greatest interest is focused on how the size of this high voltage portion can be reduced in order to achieve a larger scale for the integrated circuit for liquid crystal display apparatus drive.

SUMMARY OF THE INVENTION

An object of the present invention, which has been completed by addressing the problem of integrated circuits for liquid crystal display apparatus drive in the prior art discussed above, is to achieve a larger scale for an integrated circuit for liquid crystal display apparatus drives by reducing the pattern area of the high voltage portion.

In order to achieve the object described above, the present invention adopts the following structures.

(Structure 1)

An integrated circuit for liquid crystal display apparatus drives that comprises an input unit that performs input of a digital signal for liquid crystal display drive, a digital/analog conversion unit that converts the digital signal, which has undergone specific processing after it has been input, to an analog signal and an amplifier unit that amplifies the output from the digital/analog conversion unit to a signal level required for driving the liquid crystal apparatus.

(Structure 2)

An integrated circuit for liquid crystal display apparatus drives that comprises an input unit that performs input of a digital signal for liquid crystal apparatus drive, a digital/analog conversion unit that converts the digital signal, which has undergone specific processing after it has been input, to an analog signal and an amplifier unit that amplifies the output from the digital/analog conversion unit to a signal level required for driving the liquid crystal apparatus, with the amplifier unit constituted of an operating amplifier and a resistor for amplification factor selection.

(Structure 3)

An integrated circuit for liquid crystal display apparatus drives that comprises an input unit that performs input of a digital signal for liquid crystal apparatus drives; a digital/analog conversion unit that converts the digital signal, which has undergone specific processing after it has been input, to an analog signal; and an amplifier unit that is provided at the output side of the digital/analog conversion unit and drives the liquid crystal apparatus. The amplifier unit having an operating amplifier that outputs a signal achieved by processing the output from the digital/analog conversion unit and a reference voltage which it has received; a first switch that transfers either the output from the digital/analog conversion unit or the reference voltage to a first input terminal of the operating amplifier in response to a specific signal; and a second switch that transfers the output from the digital/analog conversion unit to a second input terminal of the operating amplifier when the reference voltage is being transferred to the first input terminal by the first switch and does not transfer the output from the digital/analog conversion unit to the second input terminal when the output from the digital/analog conversion unit is being transferred to the first input terminal by the first switch.

(Structure 4)

An integrated circuit for liquid crystal display apparatus drives that comprises; an input unit that performs input of a digital signal for liquid crystal apparatus drives; a digital/analog conversion unit that converts the digital signal, which has undergone specific processing after it has been input, to an analog signal; and an amplifier unit that is provided at the output side of the digital/analog conversion unit and drives the liquid crystal apparatus. The amplifier unit includes an operating amplifier that outputs a signal achieved by processing an output signal from the digital/analog conversion unit and a reference voltage which it has received; a first switch that transfers either the output from the digital/analog conversion unit or the reference voltage to a first input terminal of the operating amplifier in response to a specific signal; a second switch that transfers the output from the digital/analog conversion unit to a second input terminal of the operating amplifier when the reference voltage is being transferred to the first input terminal by the first switch and does not transfer the output from the digital/analog conversion unit to the second input terminal when the output from the digital/analog conversion unit is being transferred to the first input terminal by the first switch; and a resistor for determining a circuit constant for the operating amplifier.

(Structure 5)

An integrated circuit for liquid crystal display apparatus drives that comprises: an input unit that performs input of a digital signal for liquid crystal apparatus drives; a digital/analog conversion unit that converts the digital signal, which has undergone specific processing after it has been input, to an analog signal; and an amplifier unit that amplifies the output from the digital/analog conversion unit to a signal level required for driving the liquid crystal apparatus. The amplifier unit has an operating amplifier that receives an input signal achieved by adding a specific bias signal to an output signal from the digital/analog conversion unit and amplifies the input signal at a preset amplification factor.

(Structure 6)

An integrated circuit for liquid crystal display apparatus drives that comprises an input unit that performs input of a digital signal for liquid crystal apparatus drives; a digital/analog conversion unit that converts the digital signal, which has undergone specific processing after it has been input, to an analog signal; and an amplifier unit that amplifies the output from the digital/analog conversion unit to a signal level required for driving the liquid crystal apparatus. The amplifier unit has an operating amplifier that receives an input signal achieved by adding a specific bias signal to an output signal from the digital/analog conversion unit and amplifies the input signal at a preset amplification factor; a resistor for determining a circuit constant for the operating amplifier.

(Structure 7)

An integrated circuit for liquid crystal display apparatus drives that comprises; an input unit that performs input of a digital signal for liquid crystal apparatus drives; a digital/analog conversion unit that converts the digital signal, which has undergone specific processing after it has been input, to an analog signal and an amplifier unit that is provided at the output side of the digital/analog conversion unit and drives the liquid crystal apparatus. The amplifier unit includes: an operating amplifier that outputs a signal achieved by processing an output signal from the digital/analog conversion unit and a bias signal which it has received; and a switch group for directly returning the output from the operating amplifier to a negative input terminal and for converting the amplifier unit to a voltage follower circuit.

(Structure 8)

An integrated circuit for liquid crystal display apparatus drives; that comprises: an input unit that performs input of a digital signal for liquid crystal apparatus drive; a digital/analog conversion unit that converts the digital signal, which has undergone specific processing after it has been input, to an analog signal; and an amplifier unit that amplifies the output from the digital/analog conversion unit to a signal level required for driving the liquid crystal apparatus. The amplifier unit has an operating amplifier that receives an input signal achieved by adding a specific bias signal to the output signal from the digital/analog conversion unit and amplifies the input signal at a preset amplification factor; and a switch group for directly returning the output from the operating amplifier to a negative input terminal and for converting the amplifier unit to a voltage follower circuit.

(Structure 9)

An integrated circuit for liquid crystal display apparatus drives that comprises: an input unit that performs input of a digital signal for liquid crystal apparatus drive; a digital/analog conversion unit that converts the digital signal, which has undergone specific processing after it has been input, to an analog signal; and an amplifier unit that amplifies the output from the digital/analog conversion unit to a signal level required for driving the liquid crystal apparatus. The amplifier unit has an operating amplifier that receives an input signal achieved by adding a bias signal to the output signal from the digital/analog conversion unit at its positive input terminal and amplifies the input signal at a preset amplification factor, a switch that receives an output signal from the digital/analog conversion unit at its negative input terminal, and a switch group that connects a bias signal which is equal to a reference voltage to the positive input terminal of the operating amplifier when the output signal from the digital/analog conversion unit is being received at the negative input terminal.

BRIEF DESCRIPTION OF THE DRAWINGS

The above and other features of the invention and the concomitant advantages will be better understood and appreciated by persons skilled in the field to which the invention pertains in view of the following description given in the field to which the invention pertains in view of the following illustrate preferred embodiments.

DETAILED DESCRIPTION OF THE PREFERRED EMBODIMENTS

The following is a detailed explanation of the preferred embodiments of the present invention in reference to the drawings.

Figure 1A:
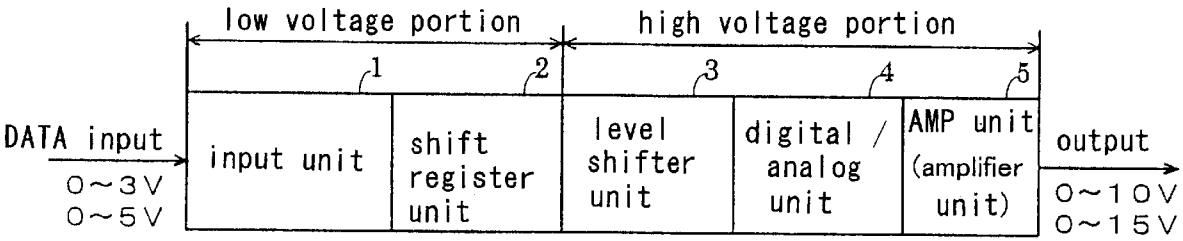
FIG. 1 illustrates the integrated circuit for liquid crystal display apparatus drive in a first embodiment.
Figure 1B:
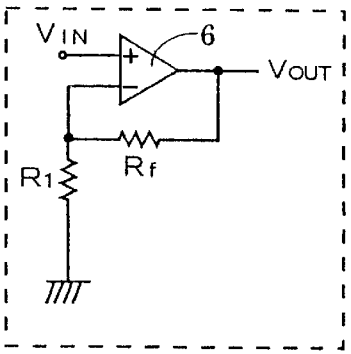
Figure 1C:
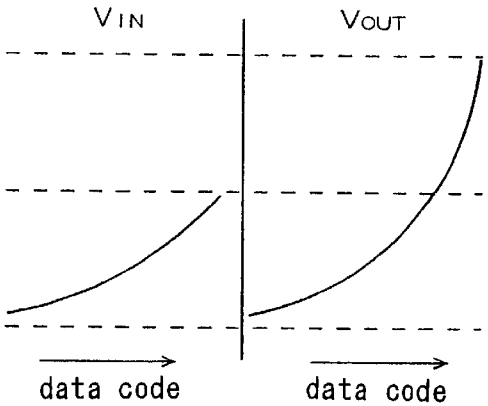

FIG. 1 illustrates the integrated circuit for liquid crystal display apparatus drives according to the first embodiment.

In order to fulfill the object of reducing the size of high voltage portion to achieve a larger scale for the integrated circuit for liquid crystal display apparatus drives, the drive circuit is improved according to the present invention.

Before giving an explanation in reference to FIG. 1, the overall structure of an integrated circuit for liquid crystal display apparatus drive is described below in reference to the first example for reference.

Figure 2A:
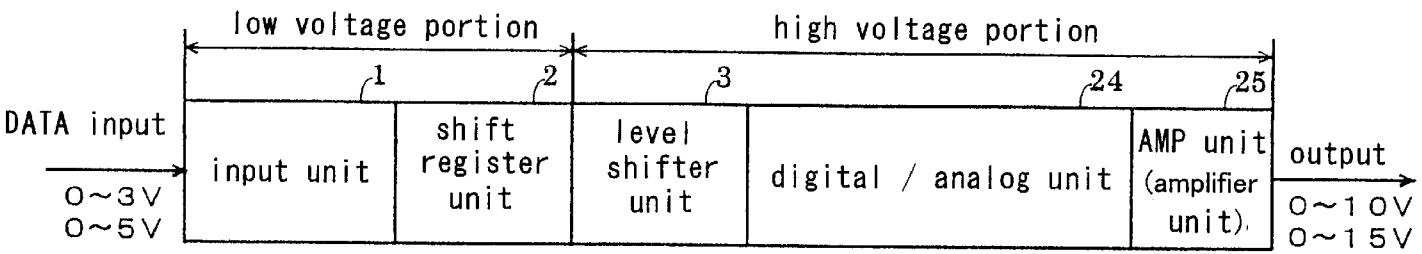
FIG. 2 illustrates an integrated circuit for liquid crystal display apparatus drive in a first example for reference.
Figure 2B:
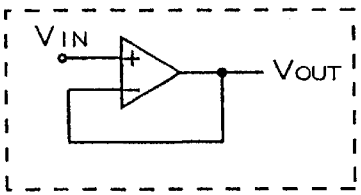
Figure 2C:
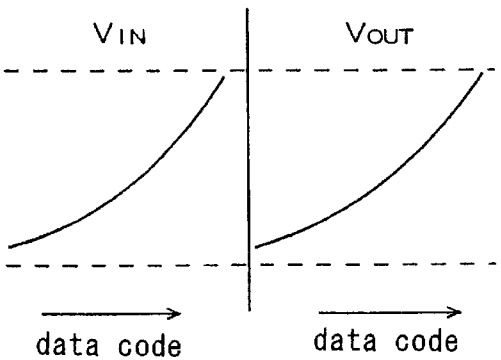

FIG. 2 illustrates the integrated circuit for liquid crystal display apparatus drives in the first example for reference. FIG. 2(*a*) is a conceptual diagram of the integrated circuit pattern for a 1-bit liquid crystal. FIG. 2(*b*) is an equivalent circuit diagram for the AMP unit 25 and FIG. 2(*c*) is a diagram of the input and output of the AMP unit 25, with the input waveform presented on the left-hand side and the output waveform presented on the right-hand side. The vertical axis represents the voltage, whereas the horizontal axis represents the data code that is transmitted.

In the figure, the integrated circuit for liquid crystal display apparatus drives for a 1-bit liquid crystal in the first example for reference is provided with an input unit 1, a shift register unit 2, a level shifter unit 3, a D/A unit 24 and the AMP unit 25. Input data often ranges over 0V to 3V and 0V to 5V under normal circumstances, whereas the output often ranges over 0V to 10V and 0V to 15V under normal circumstances. The output voltage is normally larger than the input voltage.

The input unit 1 is a buffer that receives data input in the integrated circuit for liquid crystal display apparatus drive.

The shift register unit 2 temporarily holds data received from the input unit 1 at its latch circuit and then sends the data out to the level shifter unit 3.

The level shifter unit 3 adjusts the voltage level of the data received from the shift register unit 2 to the operating specification of the D/A unit 24.

The D/A unit 24 includes of a D/A converter (digital to analog converter) that converts digital data received from the level shifter unit 3 to an analog signal.

In an integrated circuit for liquid crystal display apparatus drives in which the output voltage is larger than the input voltage, the pattern area corresponding to the D/A converter is the largest, occupying approximately ½ of the entire pattern area.

The AMP unit (amplifier unit) 25 includes a drive circuit that drives the liquid crystal by receiving the analog signal achieved through the D/A conversion at the D/A unit 24.

FIG. 2(*b*) shows a voltage follower circuit A of the AMP unit 25.

As illustrated in FIG. 2(*b*), a signal input at Vin is output at Vout at an amplification factor of alpha=1.

The input unit 1 and the shift register unit 2 operate at low voltage (hereafter referred to as the low voltage portion), whereas the level shifter unit 3, the D/A unit 24 and the AMP unit 25 operate at high voltage (hereafter referred to as the high voltage portion).

Now that the entire structure of the integrated circuit for liquid crystal display apparatus drive has been explained, reference is again made to FIG. 1 to explain the integrated circuit for liquid crystal display apparatus drive in the first embodiment.

First Embodiment

FIG. 1(*a*) is a conceptual diagram of the integrated circuit pattern, FIG. 1(*b*) is an equivalent circuit diagram for the AMP unit 5 and FIG. 1(*c*) is a diagram of the input and output of the AMP unit 5 with the input waveform presented on the left-hand side, the output waveform presented on the right-hand side, the vertical axis representing the voltage and the horizontal axis representing the data code that is transmitted.

In reference to FIG. 1(*a*), the integrated circuit for liquid crystal display apparatus drive in the first embodiment is provided with an input unit 1, a shift register unit 2, a level shifter unit 3, a D/A unit 4 and the AMP unit 5.

The AMP unit 5 is provided with a drive circuit B (see FIG. 1(*b*)). The functions of the individual components other than the drive circuit B are completely identical to those of the corresponding components in the first example for reference.

Input data often ranges over 0V to 3V and 0V to 5V under normal circumstances, whereas the output often ranges over 0V to 10V and 0V to 15V under normal circumstances. The output voltage is normally larger than the input voltage.

The integrated circuit for liquid crystal display apparatus drives in the first embodiment is provided with the drive circuit B (see FIG. 1(*b*)) at the AMP unit 5.

In FIG. 1(*b*), the drive circuit B in the first embodiment comprises an operating amplifier 6 and resistors R1 and Rf.

When the input is expressed as Vin, the output is expressed as Vout and the operating amplifier 6 is assumed to be an ideal AMP, the following formula is obtained through simple circuit calculation.

$$Vout=Vin\ (1+Rf/R1)\ \ldots\ \text{formula (1)}$$

With Rf set equal to R1 (Rf=R1) in order to facilitate the explanation, Vout=2Vin for formula (1) and it is possible to output an output voltage that is twice as large as the input voltage.

As illustrated in FIG. 1(*b*), 0V to 10V is output when an input of 0V to 5V is received.

While the explanation is given above with Rf set equal to R1 (Rf=R1) in order to facilitate the explanation, the present invention is not necessarily limited to this setting. Such an example is presented below.

Figure 3:
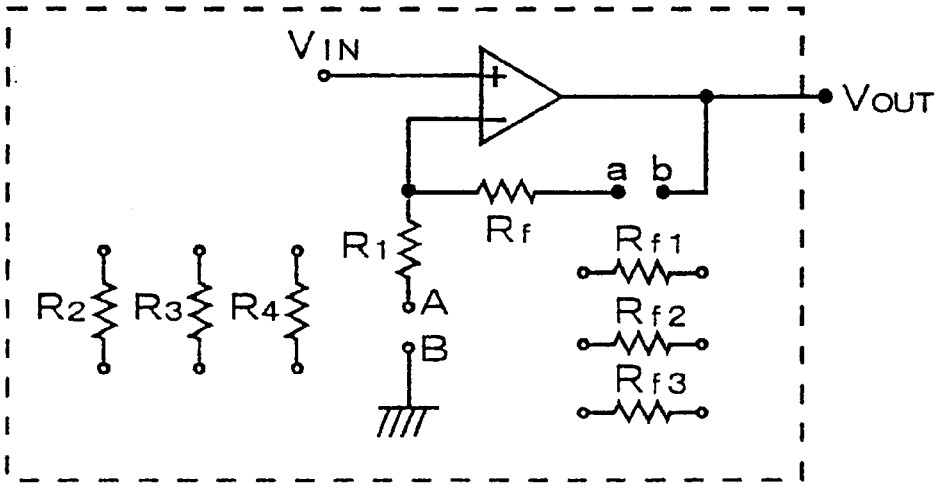
FIG. 3 is a circuit diagram illustrating an equivalent circuit for the drive circuit C.

FIG. 3 is an equivalent circuit diagram of the drive circuit C.

The amplification factor can be set freely by connecting resistors having different resistance values, e.g., R2 to R4 and Rf1 to Rf3 or the like, to the resistor R1 between A and B and the resistor Rf between a and b respectively. The amplification factor can be determined easily through formula (1). These resistors are defined as resistors for amplification factor selection. The resistors are manufactured during IC production by selecting appropriate values from several preset resistance values.

(Advantages of the first embodiment)

By providing the drive circuit B with an amplification factor alpha>1 at the AMP unit 5, the voltage of the signal transmitted from the D/A unit 4 to the AMP unit 5 can be set lower by the amplification factor 1/alpha. The following advantages are achieved as a result.

1. The pattern area corresponding to the D/A unit can be reduced.
2. Consequently, the number of dots that can be placed within the same pattern area increases.
3. As a result, it becomes possible to achieve a larger scale for an integrated circuit for liquid crystal display apparatus drive.
4. Furthermore, by providing the drive circuit C (see FIG. 3) which is structured to make it possible to vary the resistors R1 and Rf at the drive circuit B (see FIG. 1(*b*)), the amplification factor at the AMP can be freely varied.

Second Embodiment

Figure 4A:
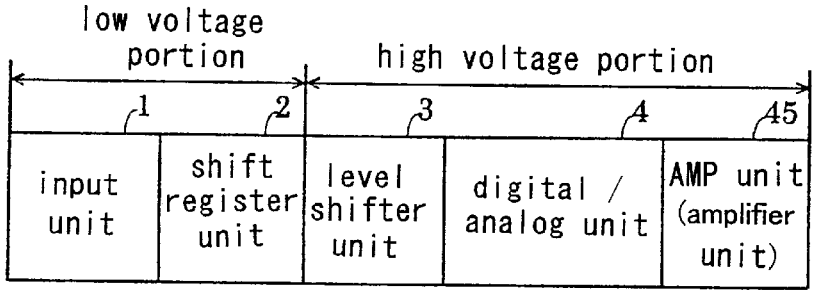
FIG. 4 illustrates the integrated circuit for liquid crystal display apparatus drive in a second embodiment.
Figure 4B:
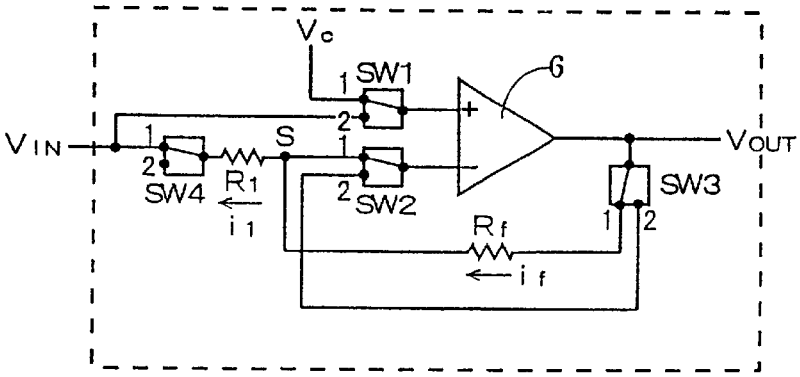
Figure 4C:
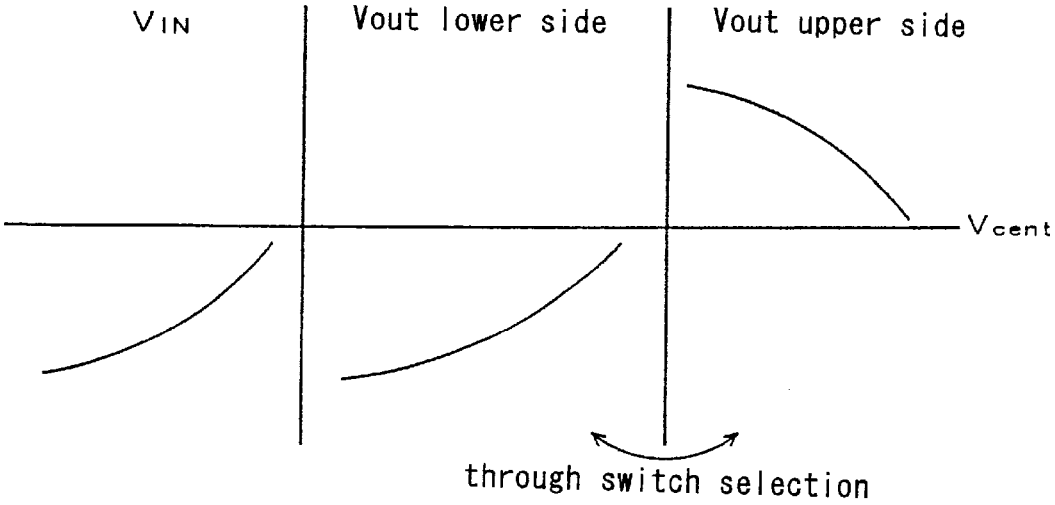

FIG. 4 illustrates the integrated circuit for liquid crystal display apparatus drives in the second embodiment.

The integrated circuit for liquid crystal display drive in the second embodiment adopts the dot inversion drive operating method.

Before an explanation is given in reference to FIG. 4, the details of the dot inversion drive operating method are outlined in reference to the second example for reference.

Figure 5A:
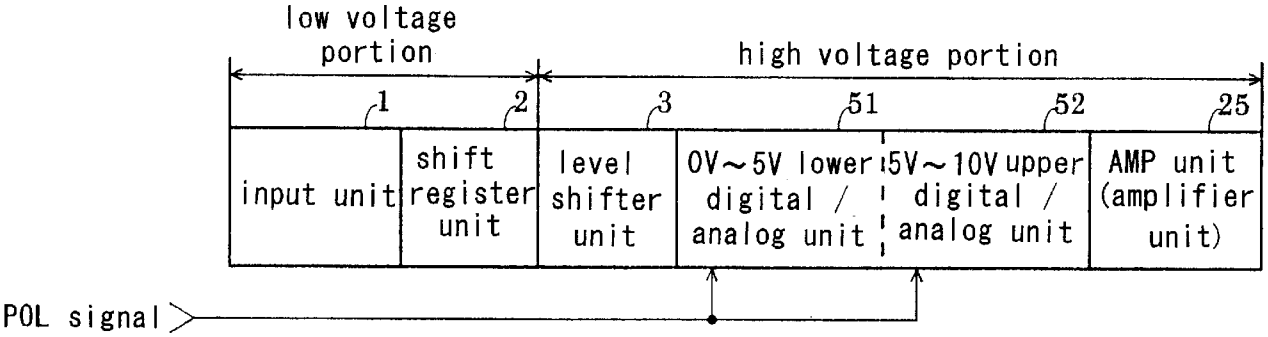
FIG. 5 illustrates the dot inversion drive operating method in a second example for reference.
Figure 5B:
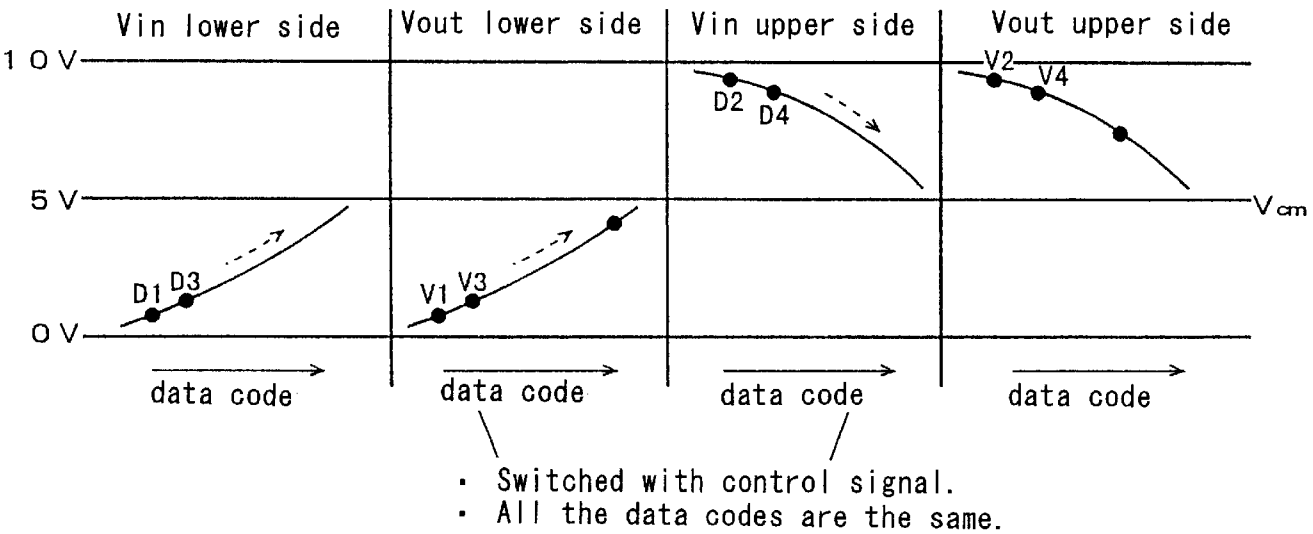

FIG. 5 illustrates the dot inversion drive operating method in the second example for reference.

The dot inversion drive operating method refers to the drive operating method whereby level inversion is achieved for the output voltage level of the drive circuit for every dot by using a roughly intermediate voltage with respect to the dynamic range of the drive circuit output side as the line of symmetry.

The following is an explanation of the dot inversion drive operating method in reference to FIG. 5.

FIG. 5(*a*) is a conceptual diagram of an integrated circuit pattern.

The D/A unit is divided into a lower D/A unit 51 and an upper D/A unit 52 and they are switched by a POL signal for every dot. The structural features other than this are identical to those in the integrated circuit for liquid crystal display apparatus drive in the first example for reference illustrated in FIG. 2.

FIG. 5(*b*) is an input/output waveform diagram of the AMP unit in the dot inversion method, with the waveforms at the Vin lower side, the Vout lower side, the Vin upper side and the Vout upper side presented starting from the left-hand side. In each waveform diagram, the horizontal axis represents the data code and the vertical axis represents the voltage level.

Now, an overview of the operation is explained.

The operation performed prior the processing performed by the level shifter unit 3 is identical to the operation performed by the integrated circuit for liquid crystal display apparatus drive in the first example for reference illustrated in FIG. 2.

Now, assuming that data D1 are first transmitted to the lower D/A unit 51 from the level shifter unit 3, the data D1 then undergo D/A conversion through a normal operation at the lower D/A unit 51. The value achieved through the D/A conversion is indicated by the point DI at the Vin lower side in FIG. 5(*b*). The data D1 are sent to the AMP unit 25. The output of the AMP unit 25 which is a voltage follower circuit A (see FIG. 2) having an amplification factor of alpha=1, is indicated as point V1 at the Vout lower side. The operation performed up to this point is identical to the operation performed by the integrated circuit for liquid crystal display apparatus drive in the first example for reference illustrated in FIG. 2.

Next, assuming that data D2 are sent after the data D1 from the level shifter unit 3, in order to achieve dot inversion for this output, the data D2 are sent to the upper D/A unit 52 by the POL signal. The upper limit voltage level (YOV in the figure) is set at a reference level at the upper D/A unit 52. A value achieved by performing D/A conversion on the data D2 is subtracted from the reference level. The result is indicated as the point D2 at the Vin upper side in FIG. 5(*b*). This D2 is then transmitted to the AMP unit 25. The output from the AMP unit 25 which includes the voltage follower circuit A (see FIG. 2) having the amplification factor alpha=1, is indicated as the point V2 at the Vout upper side.

Subsequently, the dot inversion operation is repeated alternately for data D3, D4 . . . in the same manner.

Consequently, the output from the AMP unit 25 achieves line symmetry around the center Vc (5V in the figure, and this voltage is defined as a reference voltage), and is presented by points on the curves at the Vout lower side and the Vout upper side (this is defined as a dual output mode). With regards to the second example for reference that two D/A units, i.e., the lower D/A unit 51 and the upper D/A unit 52, are required.

Now that the dot inversion drive operating method has been explained in reference to the second example for reference, reference is made again to FIG. 4 so that the integrated circuit for liquid crystal display apparatus drives in the second embodiment can be explained.

FIG. 4(*a*) is a conceptual diagram of the integrated circuit pattern, FIG. 4(*b*) is an equivalent circuit diagram of an AMP unit 45 and FIG. 4(*c*) is a diagram of the input and output of the AMP unit 45. Presenting the input waveform Vin and the waveforms at the Vout lower side and at the Vout upper side from the left-hand side. In each waveform diagram, the horizontal axis represents the data code and the vertical axis represents the voltage level.

The integrated circuit for liquid crystal display apparatus drive in the second embodiment shown in FIG. 4(*a*) comprises an input unit 1, a shift register unit 2, a level shifter unit 3, a D/A unit 4 and the AMP unit 45.

A drive circuit D (see FIG. 4(*b*)) is provided at the AMP unit 45.

In FIG. 4(*b*), the drive circuit D is provided with an operating amplifier 6, resistors R1 and Rf and four selector switches SW1 to SW4.

The individual components other than the drive circuit D (see FIG. 4(*b*)) constituting the AMP unit 45 are completely identical to the corresponding components in the first embodiment.

Next, the operation performed in the second embodiment is explained.

First, the four selector switches SW1 to SW4 are switched to their No. 2 terminals. At this point, the drive circuit D includes a voltage follower circuit A (see FIG. 2(*b*)).

Consequently, when Vin at the left-hand side in FIG. 4(*c*) is input, Vout in FIG. 4(*c*) is output.

Next, the four selector switches SW1 to SW4 are all switched to their No. 1 terminals.

Figure 6:
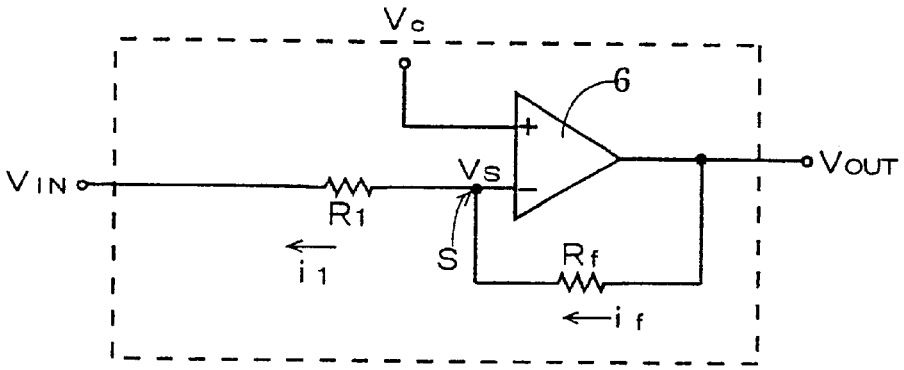
FIG. 6 is a circuit diagram illustrating an equivalent circuit for the drive circuit D-1.

FIG. 6 illustrates an equivalent circuit of the drive circuit D-1.

When the four selector switches SW1 to SW4 are switched to the terminals 1, the drive circuit D includes the drive circuit D-1 illustrated in FIG. 6. Now the operation performed by the drive circuit D-1 is explained.

When the current flowing through the resistor R1 is assigned "i1", the current flowing through the resistor Rf is assigned as "if" and the voltage at point S is assigned as Vs in an equivalent circuit of the drive circuit D-1 in FIG. 6, the following alphanumeric expressions are true.

$$Vin-Vs=R1\times i1$$

$$Vs-Vout=Rf\times if$$

Assuming that the operating amplifier 6 is an ideal AMP, $$i1=if$$

$$Vs=(Rf\times Vin+R1\times Vout)/(R1+Rf)$$

Still assuming that the operating amplifier 6 is an ideal AMP, $$Vs=Vc$$

$$Vout=Vc+(Rf/R1)(Vc-Vin) \quad \ldots \text{ formula(2)}$$

On a hypothesis that R1=Rf $$Vout=2Vc-Vin \quad \ldots \text{ formula (3)}$$

Formula (3) indicates that the output Vout achieves line symmetry with the input Vin around the center Vc.

Consequently, in the second embodiment, by switching the selector switches SW1 to SW4 between their No. 1 terminals and 2 with, for instance, the POL signal in the example for reference (see FIG. 5), a dot inversion drive output can be easily achieved.

While the explanation above is given regarding a case in which Rf=R1 to facilitate the explanation, the present invention is not restricted to this condition. Such an example is presented below.

Figure 7:
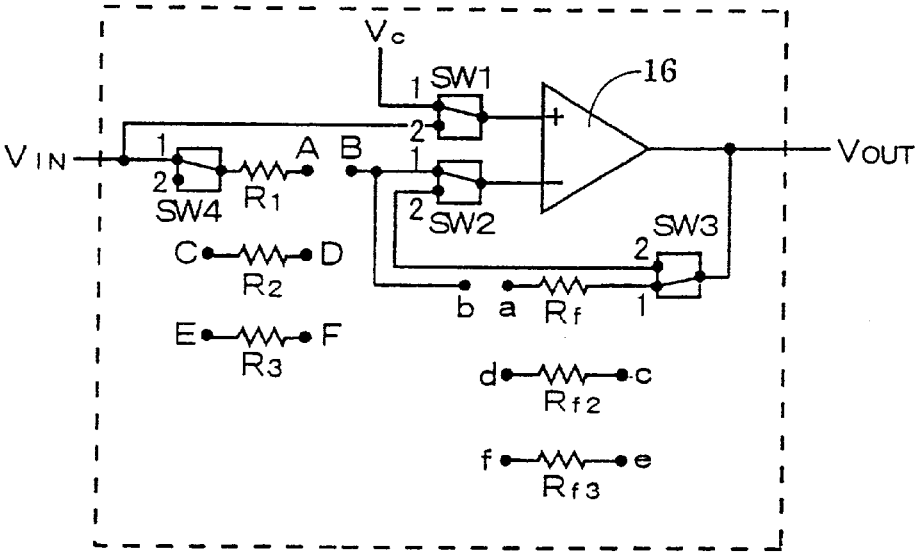
FIG. 7 is a circuit diagram illustrating an equivalent circuit for a drive circuit E.

FIG. 7 illustrates an equivalent circuit of a drive circuit E.

Resistors having different resistance values, e.g., R2 to R3 and Rf1 to Rf3 or the like can be connected to the resistor R1 and the resistor Rf respectively. By varying the resistance values, the amplification factor for the dot inversion drive output can be varied with ease when the four selector switches SW1 to SW4 are switched to their No. 1 terminals. The amplification factor can be calculated with ease using formula (2).

The amplification factor for the dot inversion drive output is hereafter referred to as an AMP inversion amplification coefficient.

Advantages of the second embodiment

The following advantages are achieved by providing the drive circuit D (see FIG. 4(*b*)) that is capable of achieving an inversion drive output through switch selection in an integrated circuit for liquid crystal display apparatus drive adopting the dot inversion drive operating method.

1. Since the D/A unit for inversion drive is not required, the circuit scale is reduced to one half the D/A conversion unit (see FIG. 5(*a*)) in the second example for reference.
2. As a result, it becomes possible to achieve a larger scale for the integrated circuit for liquid crystal display apparatus drive.
3. Furthermore, by providing the drive circuit E (see FIG. 7) achieved by selecting the resistors R1 and Rf of the drive circuit D (see FIG. 4(*b*)) during the IC production, the AMP inversion amplification coefficient can be freely changed.

Third Embodiment

Figure 8A:
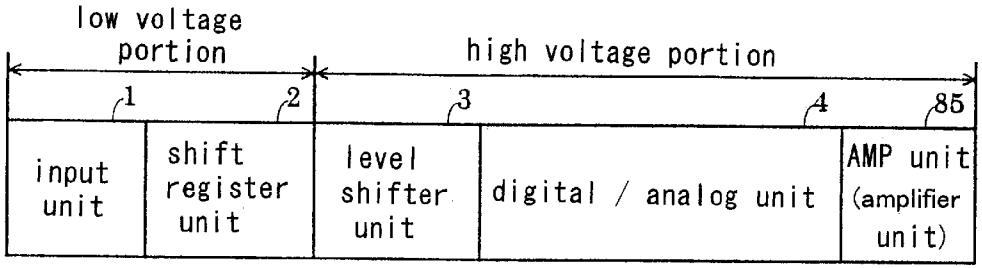
FIG. 8 illustrates the integrated circuit for liquid crystal display apparatus drive in a third embodiment.
Figure 8B:
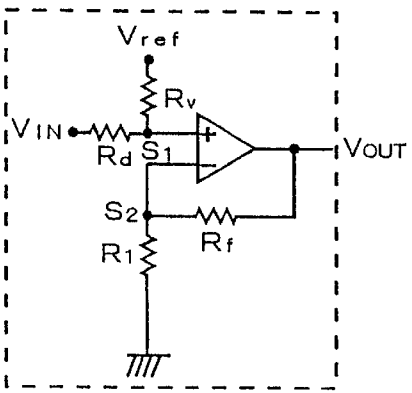
Figure 8C:
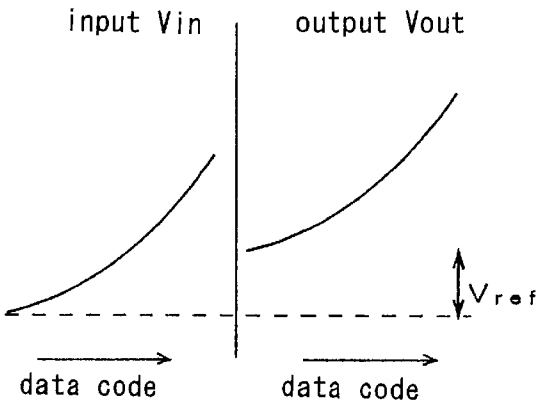

FIG. 8 illustrates the integrated circuit for liquid crystal display apparatus drive in the third embodiment.

FIG. 8(*a*) is a conceptual diagram of the integrated circuit pattern, FIG. 8(*b*) is an equivalent circuit diagram of an AMP unit 85 and FIG. 8(*c*) is a diagram of the input and output of the AMP unit 85, with the input waveform presented on the left-hand side, the output waveform presented on the right-hand side, the vertical axis representing the voltage and the horizontal axis representing the data code that is transmitted.

The integrated circuit for liquid crystal display apparatus drives in the third embodiment illustrated in FIG. 8(*a*) is provided with an input unit 1, a shift register unit 2, a level shifter unit 3, a D/A unit 4 and the AMP unit 85.

The AMP unit 85 is provided with a drive circuit F (see FIG. 8(*b*)). The functions fulfilled by the individual components other than the drive circuit F are completely identical to those fulfilled by the corresponding components in the first embodiment.

In FIG. 8(*b*), an equivalent circuit diagram of the drive circuit F in the third embodiment is provided with a register R1, a resistor Rf, a resistor Rv and a resistor Rd.

In addition, a reference voltage Vref is applied from a reference terminal.

Next, the operation performed in the third embodiment is explained.

First, the equivalent circuit diagram of the drive circuit F in FIG. 8(*b*) is explained. In FIG. 8(*b*), the point of intersection of Rd and Rv and the point of intersection of R1 and Rf are respectively assigned as S1 and S2.

With the voltages at these points of intersection expressed as Vs1 and Vs2 respectively, the relationship between the input Vin and the output Vout is expressed as follows.

$$Vs1:(Rd\times(Vref+Vin))/(Rd+Rv)$$

$$Vs2=(R1\times Vout)/(R1+Rf)$$

Assuming that the operating amplifier 6 is an ideal AMP, $$Vs1=Vs2$$

$$Rd\times(Vref+Vin))/(Rd+Rv)=(R1\times Vout)/(R1+Rf)$$

$$Vout=(R1+Rf)*Rd*(Vref+Vin)/R1*(Rd+Rv) \quad \ldots \text{ formula (4)}$$

If R1=Rf and Rd=Rv in formula (4), Vout=Vref+Vin is true, and the output voltage Vout achieves a value obtained by shifting the level of the input voltage Vin by Vref. This relationship is illustrated in FIG. 8(*c*).

While the explanation has been given on a case in which R1=Rf and Rd=Rv to facilitate the explanation, the present invention is not necessarily limited to this condition. Such an example is given below.

Figure 9:
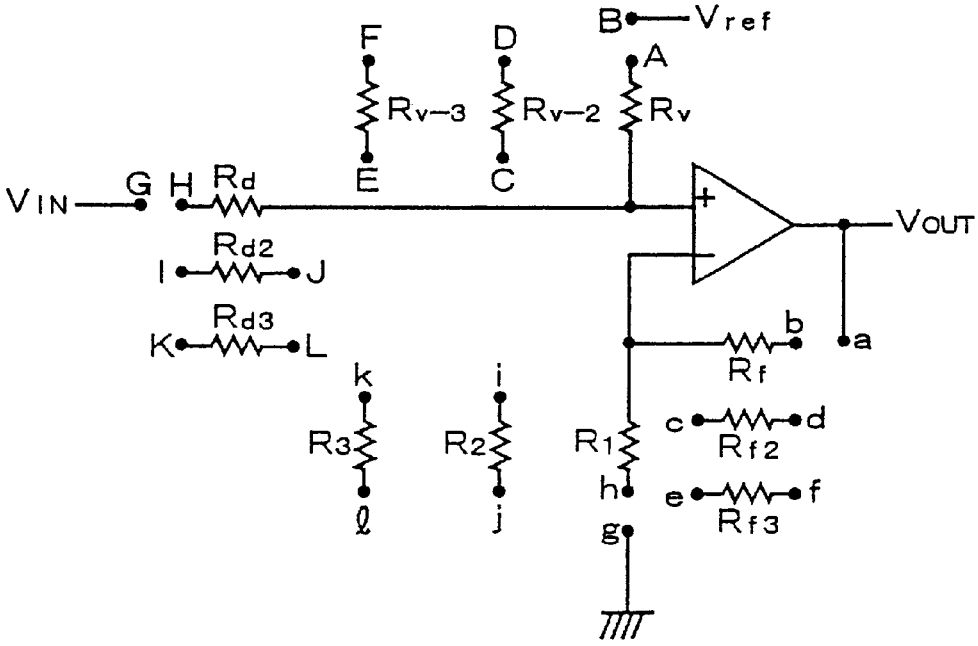
FIG. 9 is a circuit diagram illustrating an equivalent circuit for the drive circuit G.

FIG. 9 is an equivalent circuit diagram of a drive circuit G.

The quantity of the level shift can be freely set by connecting resistors having different resistance values to the resistors R1, Rf, Rd and Rv, e.g., R2 to R4, Rf1 to Rf3, Rd1 to Rd3, Rv1 to Rv3 or the like between A and B, between a and b, between G and H and between g and h respectively. This level shift quantity can be easily determined through formula (4).

Furthermore, by changing the ratio of Rf and R1, the amplification factor can be freely set together with the level shift quantity. The amplification factor can be calculated with ease through formula (1).

Advantages of the third embodiment

The following advantages are achieved by providing the drive circuit F (see FIG. 8(*b*)) which is capable of applying the reference voltage Vref through the reference terminal.

1. A great reduction in the size of the level shifter unit 3 can be achieved.
2. As a result, it becomes possible to achieve a larger scale for an integrated circuit for liquid crystal display apparatus drive.
3. Furthermore, by providing the drive circuit G (see FIG. 9) in which the resistance values of the resistors R1, Rf, Rd and Rv at the drive circuit F (see FIG. 8(*b*)) can be varied, the level shift quantity of the AMP output Vout and the amplification factor can be set freely.

Fourth Embodiment

Figure 10A:
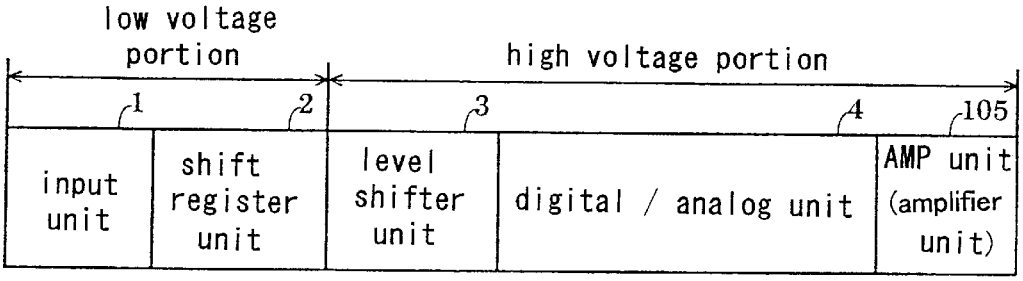
FIG. 10 illustrates the integrated circuit for liquid crystal display apparatus drive in a fourth embodiment.
Figure 10B:
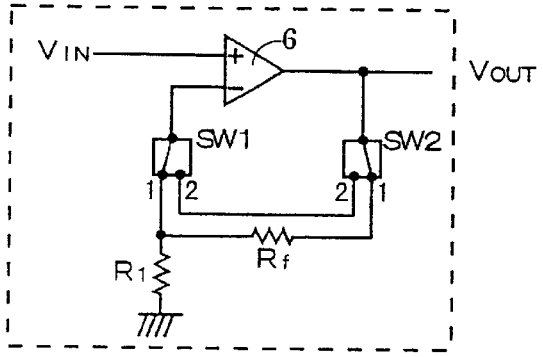
Figure 10C:
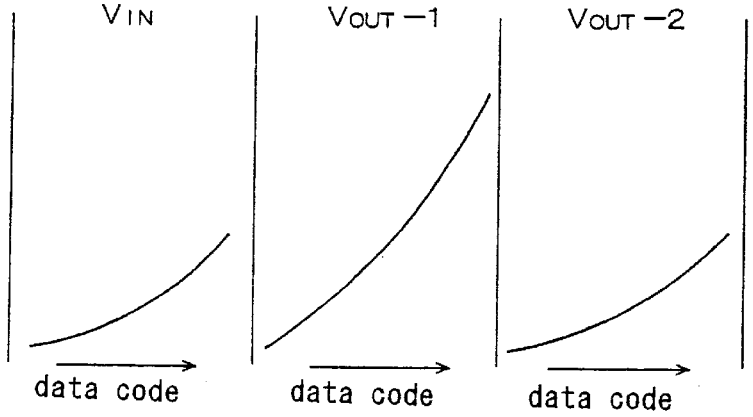

FIG. 10 illustrates the integrated circuit for liquid crystal display apparatus drive in the fourth embodiment.

FIG. 10(*a*) is a conceptual diagram of the integrated circuit pattern, FIG. 10(*b*) is an equivalent circuit diagram of an AMP unit 105 and FIG. 10(*c*) is a diagram of the input and output of the AMP unit 105 with the input waveform Vin presented on the left-hand side, the output waveform Vout-1 presented in the middle, the output waveform Vout-2 presented on the right-hand side, the vertical axis representing the voltage and the horizontal axis representing the data code that is transmitted.

As illustrated in FIG. 10(*a*), the integrated circuit for liquid crystal display apparatus drive in the fourth embodiment is provided with an input unit 1, a shift register unit 2, a level shifter unit 3, a D/A unit 4 and the AMP unit 105.

The AMP unit 105 is provided with a drive circuit H (see FIG. 10(*b*)). The functions fulfilled by the individual components other than the drive circuit H are completely identical to those fulfilled by the corresponding components in the first embodiment.

In FIG. 10(*b*), an equivalent circuit of the drive circuit H in the fourth embodiment is provided with an operating amplifier 6, a resistor R1, a resistor Rf and two selector switches SW1 and SW2. The connections of the two selector switches SW1 and SW2 can be switched between their terminals 1 and terminals 2 with an external signal, e.g., a POL signal.

When the two selector switches SW1 and SW2 are connected to the terminals 1, the drive circuit H is completely identical to the drive circuit B (see FIG. 1(*b*)) in the first embodiment. In addition, when the two selector switches SW1 and SW2 are connected to the terminals 2, the drive circuit H is completely identical to the voltage follower circuit A (see FIG. 2(*b*)) in the first example for reference (see FIG. 2).

Thus, when the two selector switches SWl and SW2 are connected to the terminals 1, Vout-1 is output as a result of Vin being input, as illustrated in 10(*c*). Likewise, if Vin is input when the selector switches SW1 and SW2 are connected to the terminals 2, Vout-2 is output as illustrated in 10(*c*).

Advantages of the fourth embodiment

By providing the drive circuit H which can be switched to function as the voltage follower circuit A (see FIG. 2(*b*)) in the first example for reference (see FIG. 2) and to function as the drive circuit B (see FIG. 1(*b*)) in the first embodiment with the selector switches, the following advantages are achieved.

1. One type of device can fulfill functions of multiple devices, e.g., an output of 0V to 3V with an input of 0V to 3V and an output of 0V to 9V with an input of 0V to 3V.
2. Consequently, it becomes possible to achieve mass production of a small number of different products to realize a reduction in production costs.

Fifth Embodiment

Figure 11A:
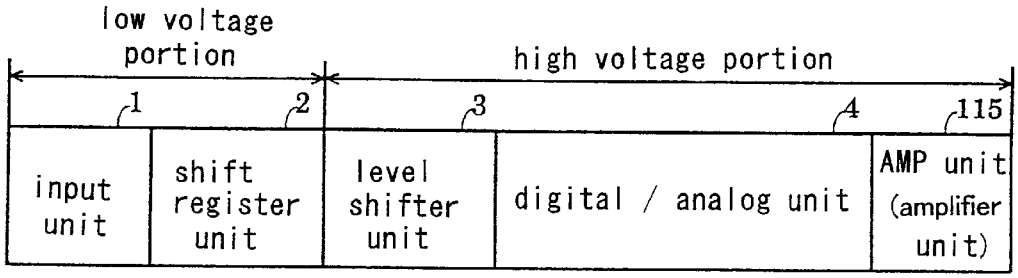
FIG. 11 illustrates the integrated circuit for liquid crystal display apparatus drive in a fifth embodiment.
Figure 11B:
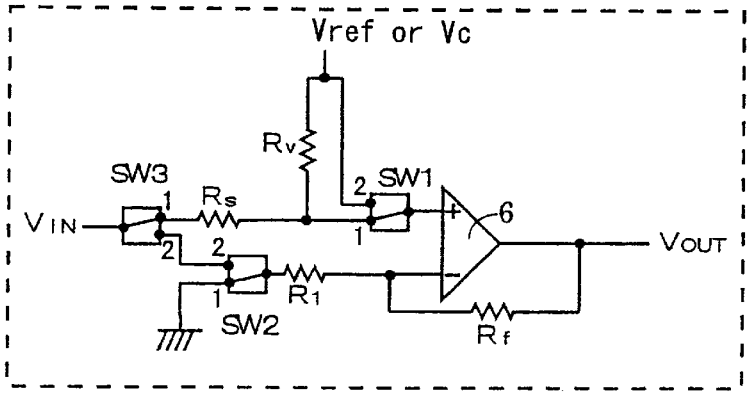
Figure 11C:
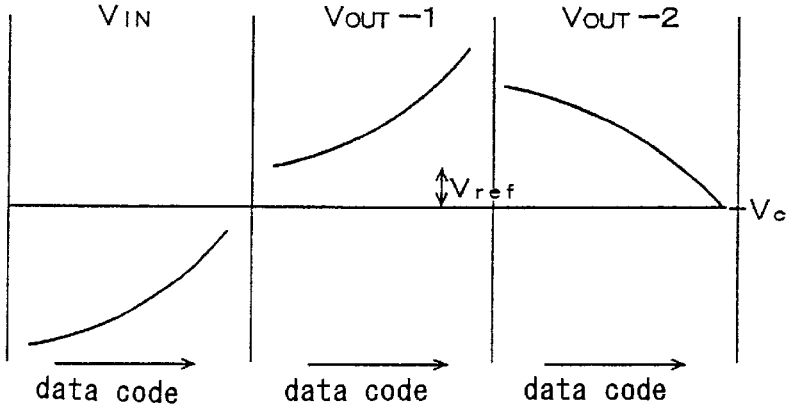

FIG. 11 illustrates the integrated circuit for liquid crystal display apparatus drive in the fifth embodiment.

FIG. 11(*a*) is a conceptual diagram of the integrated circuit pattern, FIG. 11(*b*) is an equivalent circuit diagram of an AMP unit 115 and FIG. 11(*c*) is a waveform diagram of the input and output of the AMP unit 115 with the input waveform Vin presented on the left-hand side, the output waveform Vout-1 presented in the middle, the output waveform Vout-2 presented on the right-hand side, the vertical axis representing the voltage and the horizontal axis representing the data code that is transmitted.

As illustrated in FIG. 11(*a*), the integrated circuit for liquid crystal display apparatus drives in the fifth embodiment is provided with an input unit 1, a shift register unit 2, a level shifter unit 3, a D/A unit 4 and the AMP unit 115.

The AMP unit 115 is provided with a drive circuit 1 (see FIG. 11(*b*)). The functions fulfilled by the individual components other than the drive circuit 1 are completely identical to those fulfilled by the corresponding components in the first embodiment.

In FIG. 11(*b*), an equivalent circuit of the drive circuit in the fifth embodiment is provided with an operating amplifier 6, a resistor R1, a resistor Rf, a resistor Rs, a resistor Rv, and three selector switches SW1, SW2 and SW3. The connections of the three selector switches SW1, SW2 and SW3 can be switched between their No. 1 terminals and their No. 2 terminals by an external signal, e.g., a POL signal.

When the three selector switches SW1, SW2 and SW3 are connected to the terminals 1, the drive circuit 1 is completely identical to the drive circuit F (see FIG. 8(*b*)) in the third embodiment.

In addition, when the three selector switches SW1, SW2 and SW3 are connected to the terminals 2, the drive circuit 1 achieves a state that is completely identical to the state in which the switches are connected to the terminals 1 in the drive circuit D in the second embodiment (see FIG. 4(*b*)).

Consequently, when the three selector switches SW1, SW2 and SW3 are connected to the terminals 1, Vout-1 is output as a result of the input of Vin, as illustrated in FIG. 11(*c*).

Likewise, if Vin is input when the three selector switches SW1, SW2 and SW3 are connected to the terminals 2, Vout-2 is output as illustrated in FIG. 11(*c*).

Advantages of the fifth embodiment

By providing the drive circuit 1 which can be switched to function as the drive circuit F (see FIG. 8 (*b*)) in the third embodiment and to function as the drive circuit D-1 in the second embodiment (see FIG. 6) with the selector switches, the following advantages are achieved.

1. Addition specifications and inversion specifications are fulfilled in a single device.
2. Consequently, mass production of a small number of different types of products is achieved to realize a reduction in production costs.

Sixth Embodiment

Figure 12A:
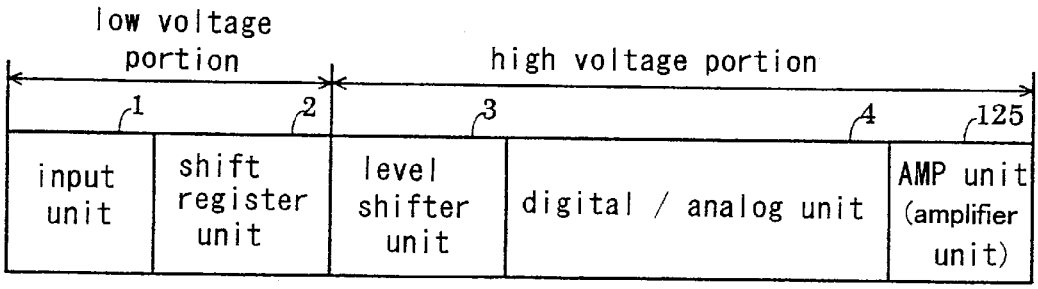
FIG. 12 illustrates the integrated circuit for liquid crystal display apparatus drive in a sixth embodiment.
Figure 12B:
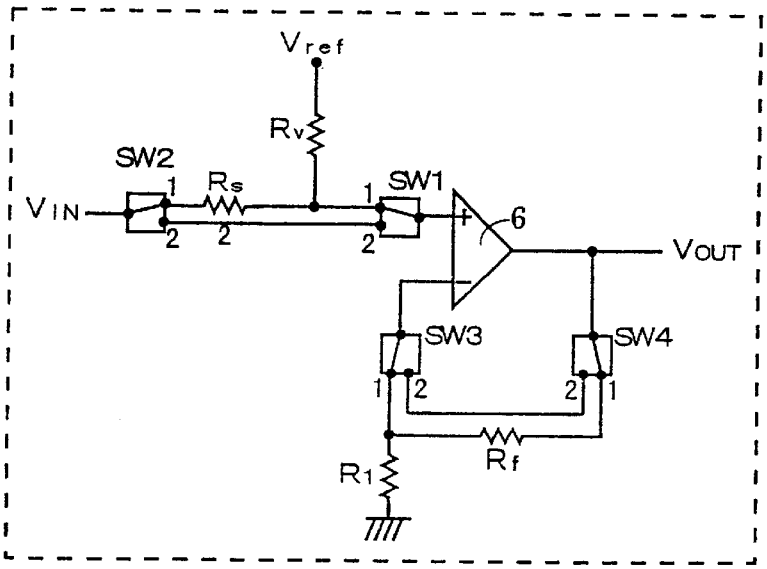
Figure 12C:
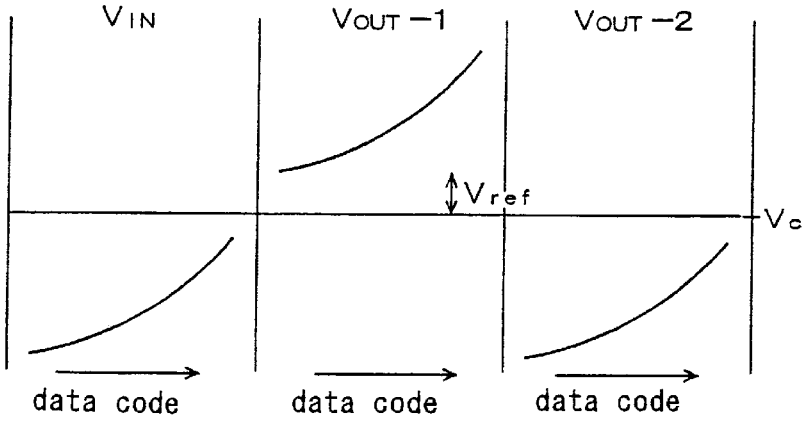

FIG. 12 illustrates the integrated circuit for liquid crystal display apparatus drive in the sixth embodiment.

FIG. 12(*a*) is a conceptual diagram of the integrated circuit pattern, FIG. 12(*b*) is an equivalent circuit diagram of an AMP unit 125 and FIG. 12(*c*) is a waveform diagram of the input and output of the AMP unit 125 with the input waveform Vin presented on the left-hand side, the output waveform Vout-1 presented in the middle, the output waveform Vout-2 presented on the right-hand side, the vertical axis representing the voltage and the horizontal axis representing the data code that is transmitted.

As illustrated in FIG. 12(*a*), the integrated circuit for liquid crystal display apparatus drive in the sixth embodiment is provided with an input unit 1, a shift register unit 2, a level shifter unit 3, a D/A unit 4 and the AMP unit 125.

The AMP unit 125 is provided with a drive circuit J (see FIG. 12(*b*)). The functions fulfilled by the individual components other than the drive circuit J are completely identical to those fulfilled by the corresponding components in the first embodiment.

In FIG. 12(*b*), an equivalent circuit of the drive circuit J 1n the sixth embodiment is provided with an operating amplifier 6, a resistor R1, a resistor Rf, a resistor Rs, a resistor Rv, and four selector switches SW1, SW2, SW3 and SW4. The connections in the four selector switches SW1, SW2, SW3 and SW4 can be switched to their No. 1 terminals and their No. 2 terminals by an external signal, e.g., a POL signal.

When the four selector switches SW1, SW2, SW3 and SW4 are connected to the terminals 1, the drive circuit J is completely identical to the drive circuit F (see FIG. 8(*b*)) in the third embodiment.

In addition, when the four selector switches SW1, SW2, SW3 and SW4 are connected to the terminals 2, the drive circuit J is completely identical to the voltage follower circuit A (see FIG. 2(*b*)) in the first example for reference (see FIG. 2).

Consequently, when the four selector switches SW1, SW2, SW3 and SW4 are connected to the terminals 1, Vout-1 is output as a result of the input of Vin, as illustrated in FIG. 12(*c*).

Likewise, if Vin is input when the four selector switches SW1, SW2, SW3 and SW4 are connected to the terminals 2, Vout-2 is output as illustrated in FIG. 12 (*c*).

Advantages of the sixth embodiment

By providing the drive circuit J which can be switched to function as the drive circuit F (see FIG. 8(*b*)) in the third embodiment and to function as the voltage follower circuit A (see FIG. 2(*b*)) in the example for reference (see FIG. 2) by the selector switches, the following advantages are achieved.

1. Low voltage specifications such as 0V–3V, 0V–5V and high voltage specifications such as 5V–10V can be fulfilled by one device.
2. Consequently, mass production of a small number of different types of products can be achieved to realize a reduction in production costs.

While the invention has been particularly shown and described with respect to preferred embodiments of the integrated circuit for liquid crystal display apparatus drive according to the present invention by referring to the attached drawings, the present invention is not limited to these examples and it will be understood by those skilled in the art that various changes in form and detail may be made therein without departing from the spirit, scope and teaching of the invention.

The entire disclosure of Japanese Patent Application No.9-366539 filed on Dec. 24, 1997 including specification, claims, drawings and summary is incorporated herein by reference in its entirety.

What is claimed is:

1. An integrated circuit for a liquid crystal display apparatus drive, comprising:

an input unit receiving a digital signal;

a digital/analog conversion unit converting the digital signal to an analog voltage signal; and an amplifier unit that amplifies the analog voltage signal to a voltage level required for driving the liquid crystal apparatus, the amplifier unit including an operational amplifier having first and second input terminals, and having an output terminal that outputs an output signal based on the voltages applied to the first and second input terminals, a first switch that transfers a reference voltage to the first input terminal when the analog voltage signal has a higher voltage level than the reference voltage and transfers the analog voltage signal to the first input terminal when the analog voltage signal has a lower voltage level than the reference voltage, and a second switch that transfers the analog signal to the second input terminal when the analog voltage signal has a higher voltage level than the reference voltage and transfers the output signal to the second input terminal when the analog voltage signal has a lower voltage level than the reference voltage.

2. An integrated circuit for a liquid crystal display apparatus drive according to claim 1, wherein the output signal from the operational amplifier is returned directly to the second input terminal, the amplifier unit functioning as a voltage follower circuit.

3. The integrated circuit for liquid crystal display apparatus drive according to claim 1, wherein the amplifier unit further includes a resistor determining a circuit constant for the operational amplifier.

4. The integrated circuit for liquid crystal display apparatus drive according to claim 3, wherein the resistor is coupled between the second input terminal of the operational amplifier and the output terminal for the operational amplifier.

5. The integrated circuit for liquid crystal display apparatus drive according to claim 4, wherein the output signal is transmitted to the second input terminal of the operational amplifier through the resistor.

6. The integrated circuit for a liquid crystal display apparatus drive according to claim 1, further comprising first and second resistors and third and fourth switches, wherein the second and third switches connect the negative input terminal of the operational amplifier with the output terminal of the operational amplifier, either directly or through the first resistor, and wherein, the fourth switch and the second resistor are connected between the output terminal of the D/A unit and a connection between the first resistor and the second switch.

7. An integrated circuit for a liquid crystal display apparatus drive, comprising:

an input unit receiving a digital signal;

a digital/analog conversion unit that converts the digital signal to an analog signal; and an amplifier unit that amplifies the analog signal to a signal level that is required for driving a liquid crystal apparatus, the amplifier unit including an operational amplifier having a negative amplifier input terminal, a positive amplifier input terminal, and an amplifier output terminal;

first and second resistors for amplification factor selection, the first resistor connected between the amplifier output terminal and the negative amplifier input terminal, the second resistor connected between the negative amplifier input terminal and a ground potential, and third and fourth resistors for a shift of the output voltage of the amplifier, the third resistor connected between the positive amplifier input terminal and an output terminal of the digital/analog conversion unit, and a fourth resistor connected-between the positive amplifier input terminal and a reference voltage.

8. The integrated circuit for a liquid crystal display apparatus drive according to claim 7, wherein the amplifier unit further includes:

a first switch that transfers the reference voltage, either directly or through the third resistor, to the positive input terminal of the operational amplifier, a second switch that transfers either of the analog signal or the ground potential to the negative input terminal of the operational amplifier, and a third switch that transfers the analog signal to either the positive input terminal of the operational amplifier or the negative input terminal of the operational amplifier, wherein, when first switch transfers the reference voltage to the positive input terminal of the operational amplifier through the first resistor, the second switch transfers the ground potential to the negative input terminal of the operational amplifier and the third switch transfers the analog signal to the positive input terminal of the operational amplifier, and wherein, when the first switch transfers the reference voltage directly to the positive input terminal of the operational amplifier, the second switch and the third switch transfer the analog signal to the negative input terminal of the operational amplifier.

9. The integrated circuit for a liquid crystal display apparatus drive according to claim 7, wherein the amplifier unit further includes:

a first switch that transfers the reference voltage to the positive input terminal of the operational amplifier through the third resistor, a second switch that transfers the analog signal, either directly or through the fourth resistor, to the positive input terminal of the operational amplifier, third and fourth switches that connect the negative input terminal of the operational amplifier with the output terminal of the operational amplifier, either directly or through the first resistor, wherein, when the first switch transfers the reference voltage to the positive input terminal of the operational amplifier through the third resistor and the second switch transfers the analog signal to the positive input terminal of the operational amplifier through the fourth resistor, the third and fourth switches connect the negative input terminal of the operational amplifier with the output terminal of the operational amplifier through the first resistor, and wherein, when the first and second switches transfer the analog signal directly to the positive input terminal of the operational amplifier, the third and fourth switches directly connect the negative input terminal of the operational amplifier with the output terminal for the operational amplifier.

* * * * *